US012213557B2

(12) United States Patent
Belforti

(10) Patent No.: US 12,213,557 B2
(45) Date of Patent: Feb. 4, 2025

(54) FOOTWEAR WITH CUSTOMIZABLE LACING SYSTEM

(71) Applicant: Reebok International Limited, London (GB)

(72) Inventor: Evan Belforti, Framingham, MA (US)

(73) Assignee: Reebok International Limited, Altrincham (GB)

( * ) Notice: Subject to any disclaimer, the term of this patent is extended or adjusted under 35 U.S.C. 154(b) by 0 days.

(21) Appl. No.: 17/960,681

(22) Filed: Oct. 5, 2022

(65) Prior Publication Data

US 2024/0115005 A1 Apr. 11, 2024

(51) Int. Cl.
*A43B 23/02* (2006.01)
*A43C 1/04* (2006.01)

(52) U.S. Cl.
CPC ..... *A43B 23/0245* (2013.01); *A43C 1/04* (2013.01)

(58) Field of Classification Search
CPC ..... A43B 23/26; A43B 5/002; A43C 5/00; A43C 1/003; A43C 1/00; A43C 1/02; A43C 3/00
See application file for complete search history.

(56) References Cited

U.S. PATENT DOCUMENTS 2,444,428 A * 7/1948 Carrier ..... A43B 5/0427 36/105
5,692,320 A * 12/1997 Nichols ..... A43B 23/0235 36/51
5,909,947 A * 6/1999 DeMarchi ..... A43B 7/1495 36/99
5,966,841 A * 10/1999 Barret ..... A43B 23/26 36/50.1
6,128,836 A * 10/2000 Barret ..... A43B 5/04 36/50.1
6,405,457 B1 * 6/2002 Basso ..... A43B 5/0482 36/119.1
7,159,340 B2 * 1/2007 Borsoi ..... A43B 23/0235 36/50.1
8,375,602 B2 * 2/2013 Takada ..... A43B 7/1495 36/50.1
8,584,378 B2 * 11/2013 Weidl ..... A43B 5/02 36/91
10,897,953 B2 * 1/2021 Champagne ..... A43B 5/1616
2004/0250452 A1 * 12/2004 Farys ..... A43B 7/12 36/89

(Continued)

FOREIGN PATENT DOCUMENTS

CN 104981175 B 1/2018
CN 111820532 A 10/2020

OTHER PUBLICATIONS

International Search Report International Application No. EP 23201592, European Patent Office, mailed on Mar. 7, 2024, 8 pages.

*Primary Examiner* — Jillian K Pierorazio
(74) *Attorney, Agent, or Firm* — Sterne, Kessler, Goldstein & Fox P.L.L.C.

(57) ABSTRACT

An article of footwear includes an upper having eyelets that define a lace pathway therebetween, a shoelace extending through the eyelets, a shell overlying the upper and defining openings over the lace pathway, and hooks coupled to the shell. The shoelace can be extended out through the openings to releasably engage with the hooks to tighten the upper.

28 Claims, 9 Drawing Sheets

(56) References Cited

U.S. PATENT DOCUMENTS

2007/0068040 A1* 3/2007 Farys ..... A43C 1/04 36/50.1
2008/0216351 A1* 9/2008 Carroll ..... A43C 1/06 24/712.1
2011/0296712 A1* 12/2011 Settele ..... A43B 5/002 36/50.1
2012/0011744 A1 1/2012 Bell et al.
2012/0167417 A1* 7/2012 McDowell ..... A43B 7/085 36/107
2013/0104422 A1* 5/2013 Hatfield ..... A43B 23/027 36/103
2013/0152425 A1* 6/2013 Borel ..... A43C 11/00 36/83
2015/0026937 A1* 1/2015 Nonogawa ..... A43C 1/04 24/713.6
2015/0257476 A1* 9/2015 Panian ..... A43B 13/22 36/114
2016/0051008 A1* 2/2016 Bell ..... A43B 1/0072 36/88
2016/0353830 A1* 12/2016 Hatfield ..... A43B 13/189
2017/0202311 A1* 7/2017 Klug ..... A43B 1/0027
2017/0245595 A1* 8/2017 Ramos ..... A43C 1/04
2017/0354204 A1* 12/2017 Giacobone ..... A43B 5/06
2018/0194043 A1* 7/2018 Hochdoerffer ..... A43B 23/0235
2018/0343974 A1* 12/2018 Hancock ..... D04B 1/26
2019/0116932 A1* 4/2019 Bell ..... A43B 23/025
2019/0116933 A1* 4/2019 Cook ..... A43B 23/0215
2019/0208863 A1* 7/2019 Adams ..... A43C 11/20
2019/0350305 A1* 11/2019 Kerr ..... A43B 5/08
2020/0022450 A1* 1/2020 Baines ..... A43B 23/0275
2020/0367608 A1* 11/2020 Wilson, Jr. ..... A43C 5/00
2020/0397090 A1 12/2020 Meir et al.
2020/0397095 A1* 12/2020 Dombrow ..... A43B 1/04
2021/0259356 A1* 8/2021 Maselino ..... A43C 1/06
2021/0259365 A1* 8/2021 Maselino ..... A43C 11/008

* cited by examiner

FOOTWEAR WITH CUSTOMIZABLE LACING SYSTEM

FIELD

The present disclosure generally relates to articles of footwear. More specifically, some embodiments relate to articles of footwear having a customizable lacing system.

BACKGROUND

An article of footwear may use a closure to tighten the article of footwear to a user's foot. The closure helps keep the user's foot from slipping at the heel and also provides extra stability to the user's foot to avoid injury during movements. An inelastic shoelace is a common type of shoe closure. However, a shoelace requires the user to tie the two free ends at every use and offers limited ways to customize the appearance and tightness of it.

SUMMARY

Some embodiments of the disclosure provide an article of footwear including an upper having eyelets that define a lace pathway therebetween, a shoelace extending through the eyelets, a shell overlying the upper and defining openings over the lace pathway, and hooks coupled to the shell. The shoelace can be extended out through the openings to releasably engage with the hooks to tighten the upper.

In some embodiments, the shoelace is elastic.

In some embodiments, the shell is not fixed to the upper in an instep region of the upper, such that the upper is free to move relative to the shell in the instep region.

In some embodiments, the shoelace forms a single loop.

In some embodiments, the shoelace is a single, continuous member having a first end and a second end, and wherein both the first and second end are fixed to the upper.

In some embodiments, the openings are arranged in a row over the lace pathway and extend longitudinally and transversely over the upper.

In some embodiments, each of the openings has a minimum diameter in a range of 10 mm to 30 mm.

In some embodiments, the openings are arranged in a single row over the lace pathway.

In some embodiments, the upper is elastic, and the shell is inelastic.

In some embodiments, the upper and the shell are flexible, and the upper is more flexible than the shell.

In some embodiments, the upper is formed of a textile material, and the shell is formed of a solid material.

In some embodiments, the shell is fixed to the article of footwear upper at a rim of a toe box of the article of footwear.

In some embodiments, the shell elastically coupled to the upper at a collar area of the upper.

In some embodiments, the hooks comprises at least four hooks.

In some embodiments, the hooks are monolithic with the shell.

In some embodiments, each of the hooks is arranged at a different distance from any one of the openings.

Some embodiments of the disclosure provide an article of footwear including an upper, an elastic shoelace coupled to the upper, a shell disposed over the upper. The shell includes a single row of openings disposed over the shoelace, and hooks disposed adjacent the openings. Bight portions of the shoelace can be pulled through the openings and over the hooks to provide tightening force.

In some embodiments, hooking bight portions of the shoelace pulled through the same opening over different hooks provides different tightening force.

In some embodiments, the shoelace can be hooked over more than one hook simultaneously.

In some embodiments, the tightening force tightens the shell to the upper.

Some embodiments of the disclosure provide a method of tightening an article of footwear, the method including pulling a shoelace through a first opening defined on a shell to form a first bight in the shoelace, hooking the first bight of the shoelace over a first hook fixed to the shell, pulling the shoelace through a second opening defined on the shell to form a second bight in the shoelace, and hooking the second bight of the shoelace over a second hook fixed to the shell. The shell overlays an upper, and the shoelace is coupled to the upper. Hooking the bights over the hooks constricts the upper relative to the shell.

In some embodiments, pulling the shoelace through the openings comprises extending a finger through the opening and pulling the shoelace through the opening with the finger.

In some embodiments, the method further includes adjusting the tightness of the article of footwear by moving one of the bights to a different hook.

BRIEF DESCRIPTION OF THE FIGURES

The accompanying drawings, which are incorporated herein and form part of the specification, illustrate embodiments of the present invention and, together with the description, further serve to explain the principles of the invention and to enable a person skilled in the relevant art(s) to make and use the invention.

DETAILED DESCRIPTION

Figure 1:
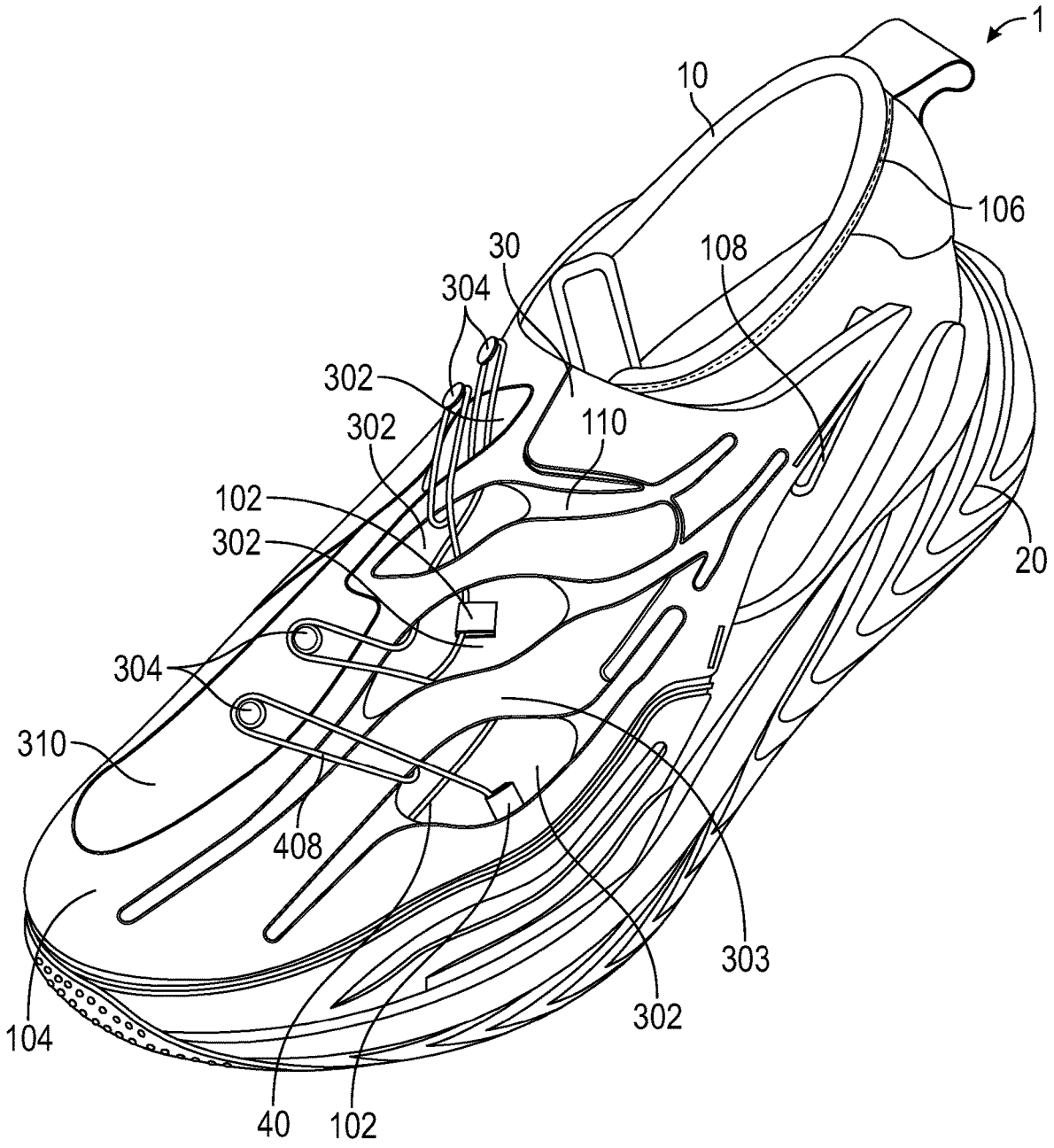
FIG. 1 is a perspective view of an article of footwear with a customizable lacing system according to some embodiments.

An article of footwear protects a user's foot from the environment and provides external support to the user's foot during movements, such as walking, running, training, and cycling. The article of footwear should be properly fitted on the user's foot to provide such protection. A loose or unfit article of footwear can cause the foot to slip out at the heel during movement, and can be uncomfortable to the user. Therefore, a closure system is used to tighten the article of footwear to the user's foot.

A shoelace is a commonly used closure for an article of footwear. While a shoelace allows a user to adjust tightening force, there are some drawbacks associated with traditional shoelaces. For example, a shoelace has two free ends that must be tied to secure the tightening force. Tying a shoelace can be difficult and time-consuming for some users. Also, a tied shoelace may become loose and untied after intense movement or if the shoelace is made of a rather smooth material. A user must therefore repeatedly tie the shoelace during the course of wearing the article of footwear. Further, a shoelace provides tightening force by threading through eyelets over the tongue area of the article footwear, so the appearance of the shoelace is defined by the eyelet pathway and cannot be easily changed based on user's aesthetic preferences.

Accordingly, there is a benefit to providing an alternative lacing system that does not require tying free ends of the shoelace, does not easily become loose over the course of wearing the article of footwear, and also provides customizable ways for a user to adjust the appearance and tightness of the shoelace without untying or re-lacing the footwear.

Embodiments of the present disclosure provide a lacing system for an article of footwear that eliminates the free ends of the shoelace, such that no tying of the shoelace is required to tighten or adjust the shoelace. In some embodiments, the shoelace forms a single loop, and in some embodiments, the ends of the shoelace are fixed to an upper of the article of the footwear. Portions of the shoelace between its ends may be movably anchored to the upper (e.g., slidable through eyelets). The article of footwear may include an inflexible shell over an instep area of the upper. The shell may have openings large enough to reach a finger through, so a user can reach the underlying shoelace through the openings. The shell may have various hooks next to its holes, so the user can pull portions of the shoelace out through the holes at various points along the shoelace, and hook these portions over the hooks. This pulls the upper tighter, since the shoelace is fixed to the upper. The user can pull one or more portions of the shoelace through any one or more of the multiple openings and hook them over one or more of the multiple hooks in many different combinations, allowing the user to customize the tightness and appearance of their footwear without tying, untying, or re-lacing the shoelaces.

The shoelace may be elastic, so each additional portion hooked over a hook may stretch the shoelace more and provide a greater tightening force. The upper may be flexible, and in some embodiments may be elastic, so that it can conform to the user's foot and contribute to the tightening force applied by the shoelaces. The shell may be inelastic, and less flexible than the upper, which can also provide extra stability and protection to the foot. In some embodiments, the shell covers the instep including the lace pathway, and the engagement between the shoelace with the hooks on the shell resembles the latch on a medieval armor, thereby deviating significantly from the traditional shoelace appearance, while improving on its customizability. The user can freely design the appearance of the lacing system by engaging the shoelace with different hooks on the shell.

The present disclosure will now be described in detail with reference to embodiments thereof as illustrated in the accompanying drawings. References to "one embodiment," "an embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Figure 2:
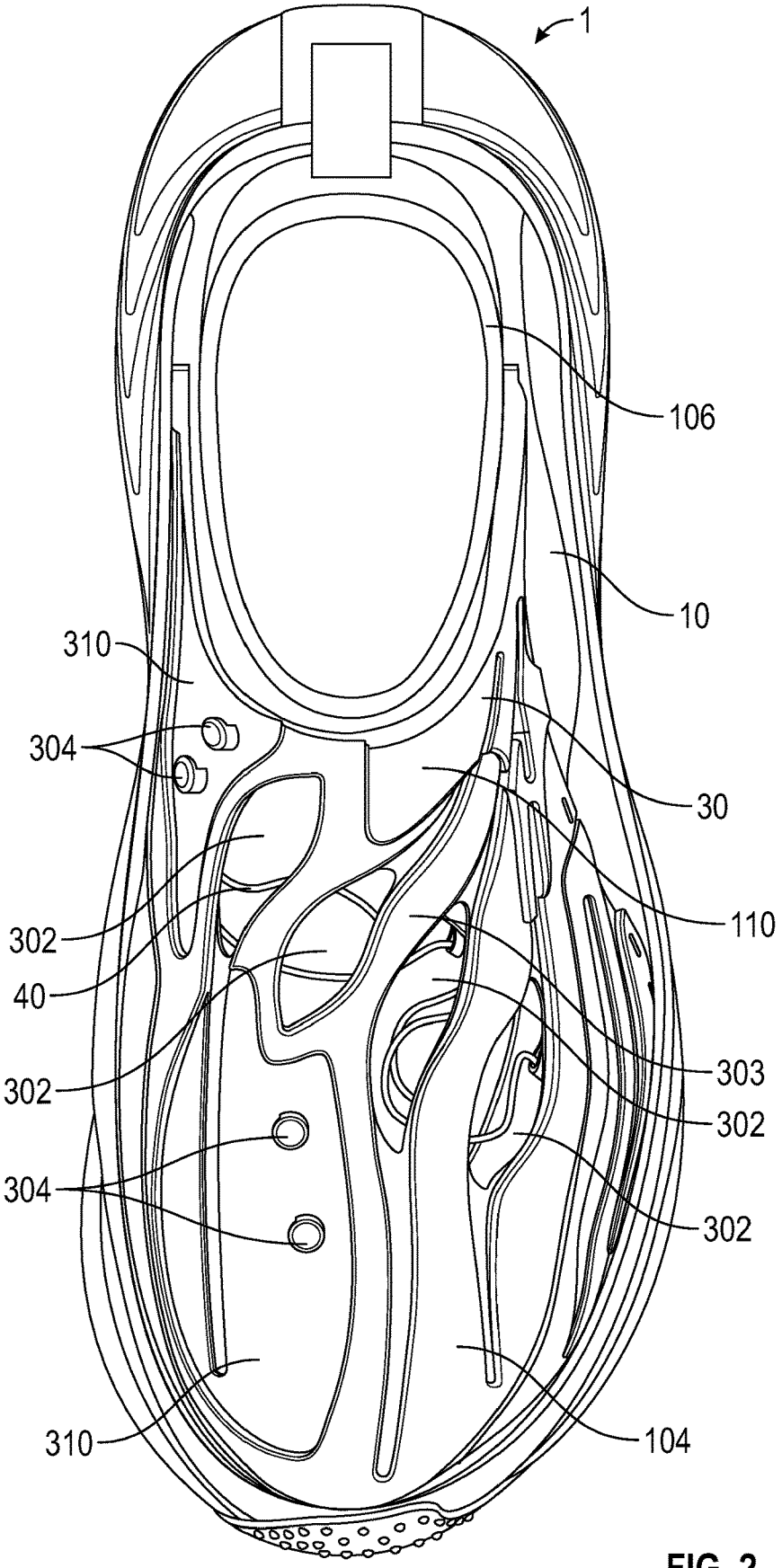
FIG. 2 is a top view of the article of footwear of FIG. 1.
Figure 4:
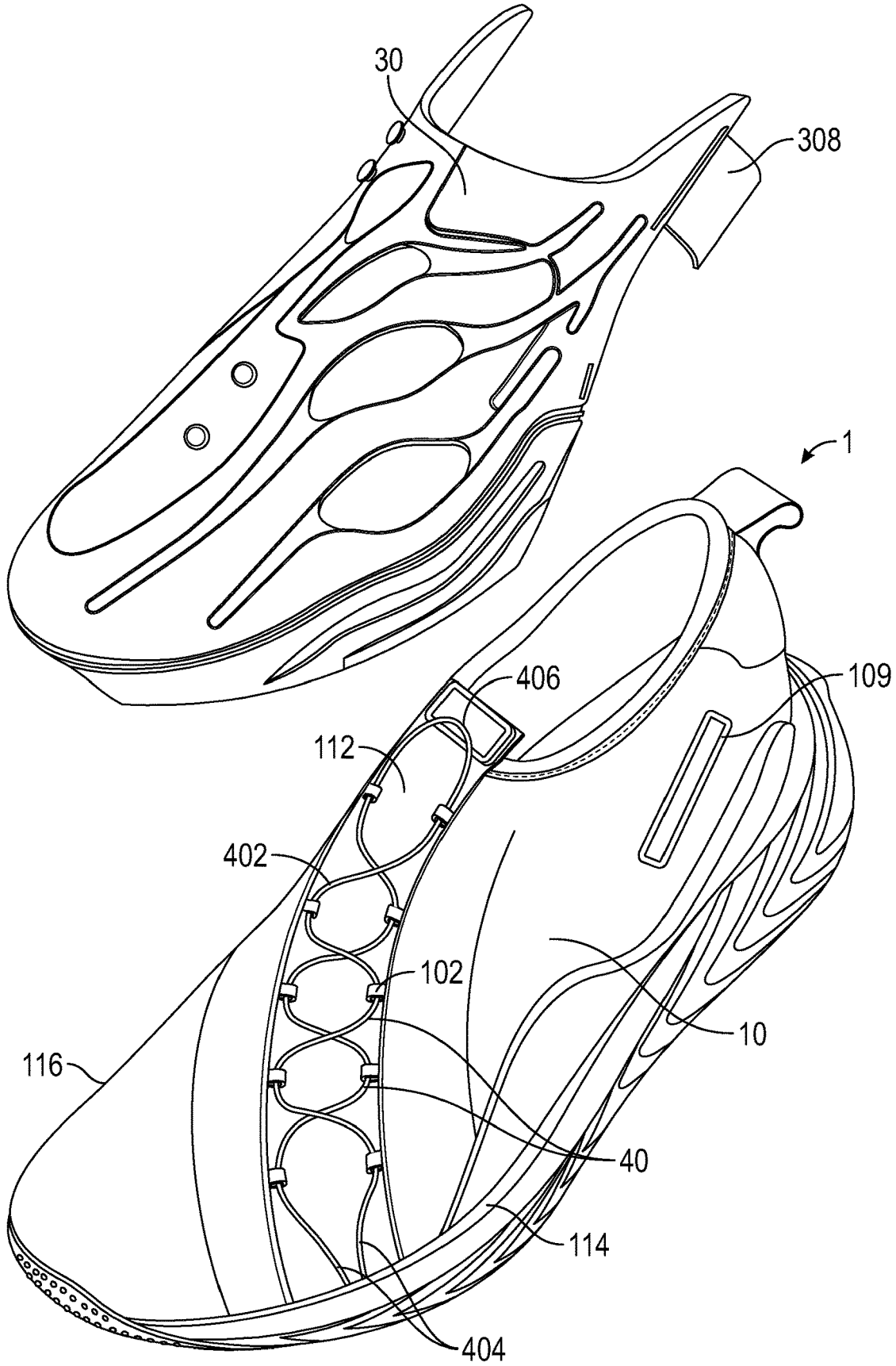
FIG. 4 is an exploded with of the article of footwear of FIG. 1.
Figure 5:
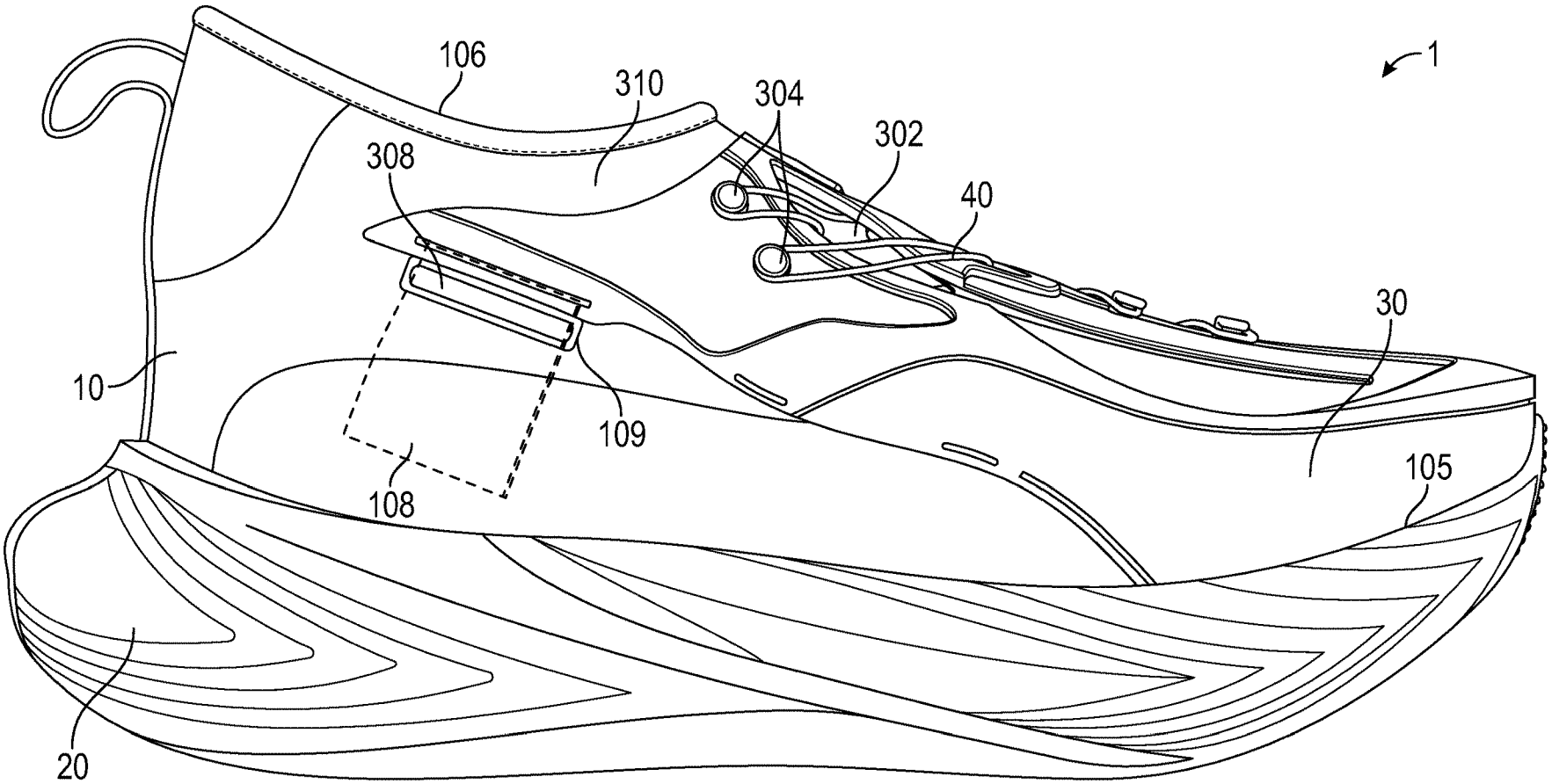
FIG. 5 is a side view of the article of footwear of FIG. 1.

With references to FIGS. 1 and 2, in some embodiments, an article of footwear 1 has an upper 10 and a sole 20 attached to upper 10. In some embodiments, eyelets 102 are disposed on or through upper 10, and shoelace 40 extends through eyelets 102 to form a lace pathway 402 (FIG. 4). In some embodiments, eyelets 102 are disposed on opposite sides of lace pathway 402, and shoelace 40 extends back and forth through eyelets 102 on opposite sides. In some embodiments, the ends of shoelace 40 are fixed onto upper 10. In another embodiment, shoelace 40 does not have free ends and forms a single loop. In some embodiments, shoelace 40 is elastic and can be pulled at any portion to provide a tightening force. When shoelace 40 is pulled, the tension biases eyelets 102 toward each other, bringing eyelets 102 closer together and constricting upper 10, thus proving a tightening force to upper 10. The tightening force can hold or tighten upper 10 around a user's foot when their foot is inserted within upper 10.

In some embodiments, shoelace 40 is made of nylon, textured polyester, spun polyester, cotton, or leather, etc. In some embodiments, shoelace 40 can have a length in a range of approximately 50 cm to approximately 100 cm (e.g., approximately 60 cm to approximately 90 cm or approximately 70 cm to approximately 80 cm).

In some embodiments, article of footwear 1 further includes a shell 30 disposed over upper 10. In some embodiments, shell 30 covers an instep region of upper 10 (including a toe box area 104 and a tongue area 110 of article of footwear 1) to provide support to the forefoot and anchors for shoelace 40. In some embodiments, shell 300 covers lace pathway 402.

In some embodiments, shell 30 includes openings 302. Openings 302 can be disposed over lace pathway 402, and shoelace 40 can be pulled through openings 302. Openings 302 can have various shapes, such as a round shape, oval shape, rectangular shape, or irregular shape. Openings 302 can have various sizes. In some embodiments, openings 302 have a size that allows at least one (e.g., two) of a user's fingers to pass through openings 302 to pinch and pull a portion of shoelace 40 out through a respective opening 302. In some embodiments, openings 302 have a minimum diameter in a range of approximately 10 mm to approximately 30 mm (e.g., approximately 15 mm to approximately 25 mm, or approximately 20 mm).

Openings 302 can also be arranged in various ways. In some embodiments, openings 302 can be arranged above lace pathway 402 and follow the direction of lace pathway 402, such that shoelace 40 is directly accessible through openings 302. In some embodiments, opening 302 can be arranged in a single row, as shown, and in some embodiments, the single row of openings 302 extend longitudinally and transversely over upper 10. In some embodiments, openings 302 can be arranged in multiple rows. In some embodiments, the portion between two adjacent openings 302 forms a bridge 303. In some embodiments, shell 30 has only one opening 302. In some embodiments, shell 30 can have more than one openings 302, such as two, three, four, or more openings 302.

In some embodiments, shell 300 also includes hooks 304 on the outer surface (e.g., the top surface) of shell 300. In some embodiments hooks 304 protrude outward from the rest of shell 300, and include a narrow body portion 305 and a wider flange portion 307 (see FIG. 3). Shoelace 40 pulled from openings 302 can releasably engage with hooks 304 to provide a constant and easily adjustable and customizable tightening force. For example, a user may pull a bight portion 408 of shoelace 40 through one of openings 302, stretch it over flange portion 307 of one of hooks 304 and deposit it against body portion 305 of the hook 304 at a recess 306 of hook 304, as shown in the example of FIG. 1. In this way bight portion 408 is held in place around hook 304, and applies and maintains tension within shoelace 40. Such tension can be customized. Stretching a bight portion 408 a longer distance (e.g., between farther-spaced openings 302 and hooks 304) applies greater tension. Stretching a single bight portion 408 around more (e.g., two) hooks 304 applies greater tension. And stretching more bight portions 408 around more hooks 304 applies greater tension (e.g., two, three, or four bights, as shown in FIG. 1). As used herein, a bight portion is a curved portion of shoelace 40 that does not include an end of shoelace 40. When pulled out from an opening 302, a bight portion's length extends out from and back into the same opening, forming an open loop or U-shape.

In some embodiments, the tightening force tightens upper 20 to a user's foot. In some embodiments, the tightening force tightens shell 30 to upper 20 to provide more stability to protect a user's foot. In some embodiments, hooks 304 are disposed around openings 302 within a distance that shoelace 40 can reach when stretched through openings 302. For example, in some embodiments, a hook 304 has a minimum distance from any one of openings 302 in a range of approximately 5 mm to approximately 120 mm (e.g., approximately 10 mm to approximately 100 mm, or approximately 20 mm to approximately 80 mm).

In some embodiments, hooks 304 are disposed near tongue area 110 of article of footwear 10. In some embodiments, hooks 304 are disposed near toe box area 104 of article of footwear 10. In some embodiments, hooks 304 are disposed closer to the same side (e.g., the medial side or the lateral side) of article of footwear 10. In some embodiments, hooks 304 are disposed on both sides of article of footwear 10. In some embodiments, hooks 304 are arranged irregularly in order to provide maximum options for a user to engage shoelace 40 with hooks 304. In some embodiments, shell 30 has only one hook 304. In some embodiments, shell 30 has more than one hook 304, such as two, three, four, or more hooks 304.

Figure 3:
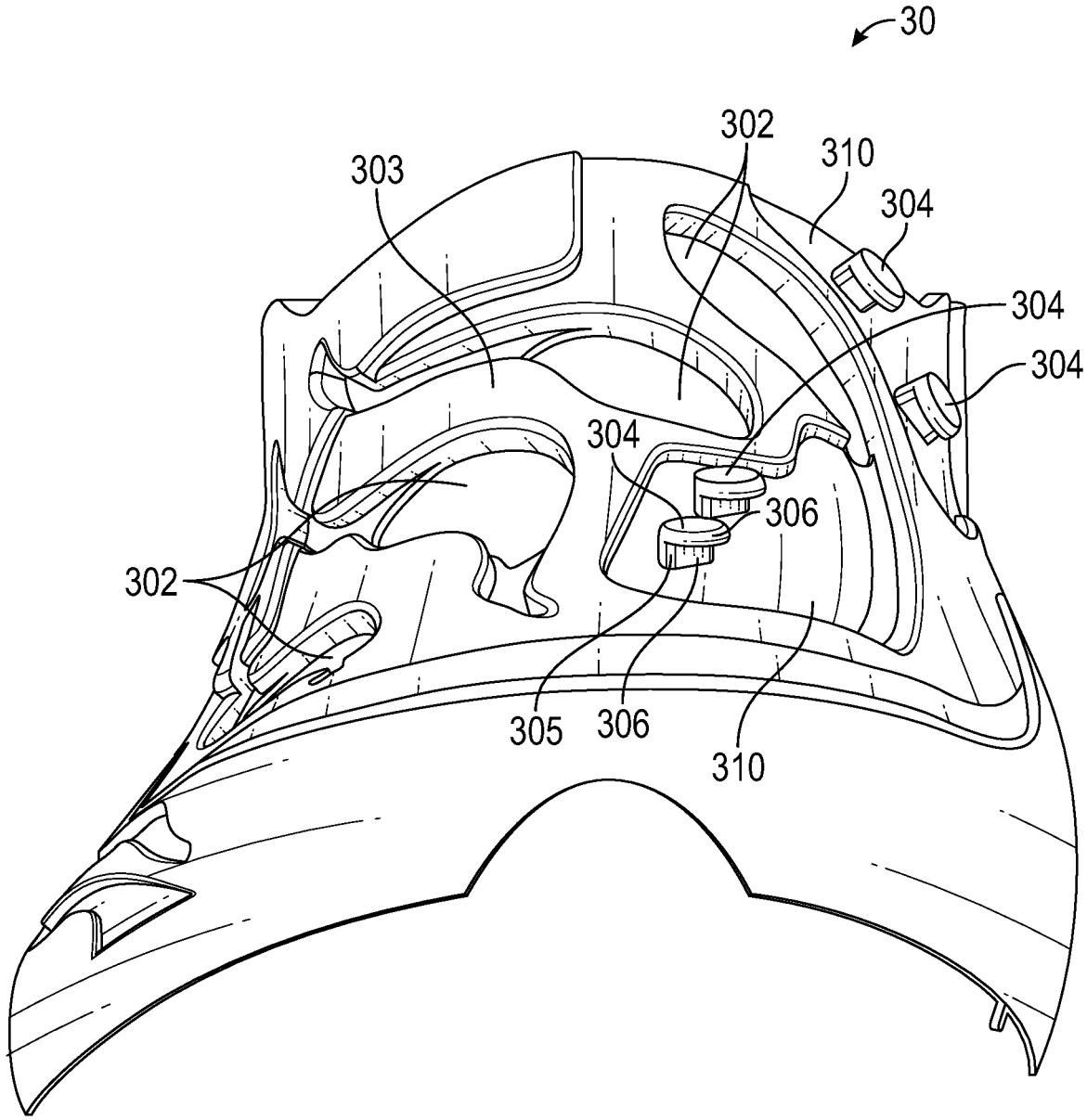
FIG. 3 is a shell of the article of footwear of FIG. 1.

FIG. 3 shows a front view of shell 30. In some embodiments, shell 30 includes a recessed portion 310, and the thickness of recessed portion 310 is less than the thickness of the rest of shell 30. In some embodiments, hooks 304 are disposed on recess portions 310 to reduce the height of the top surface of hooks 304 relative to the outer surface of shell 30.

In some embodiments, the top surfaces of hooks 304 are at approximately the same level with the outer surface of shell 30, such that wider flange portion 307 of hooks 304 are less prone to shear force, which may cause breakage in narrow body portion 305 of hooks 304. In some embodiments, narrow body portion 305 hooks 34 have a height more than a thickness of shoelace 40, in order to secure shoelace 40 under wider flange portion 307 of hooks 304. In some embodiments, narrow body portion 305 of hooks 34 have a height in a range of approximately 1 mm to approximately 5 mm, such as approximately 3 mm or approximately 2 mm. In some embodiments, wider flange portion 307 of hooks 304 has a diameter in a range of approximately 1 mm to approximately 10 mm, such as approximately 3 mm to approximately 8 mm, or approximately 5 mm. In some embodiments, hook 304 has a recess 306, which allows shoelace 40 to engage with hooks 304. In some embodiments, recess 306 is on the side of hook 304 away from opening 302, such that shoelace 40 can be pulled from opening 302, extend over hook 304, and wrap around hook 304 at recess 306. In some embodiments, hooks 304 are formed of the same material as shell 30, and in some such embodiments are monolithic with shell 30. In some embodiments hooks 304 are made of a metal or a metal alloy. In some embodiments, hooks 304 are made of a polymer, such as thermoplastic polyurethane (TPU), polyethylene or polyvinyl chloride.

In some embodiments, shell 30 is made of a polymer, such as thermoplastic polyurethane (TPU). In some embodiments, shell 30 is made of a solid material (e.g., a solid polymer). In some embodiments, shell 30 is manufactured by compression molding, injection molding, or 3D printing.

In some embodiments, shell 30 is flexible. In some embodiments, while being flexible, shell 30 is less flexible than upper 10, thereby providing extra stiffer support to upper 10 around toe box area 104 and/or tongue area 110. In some embodiments, shell 30 can be inelastic, such that it does not stretch or deform when shoelace 40 is hooked over hooks 304. An inelastic shell 30 can provide the anchor points for shoelace 40 as shoelace 40 tightens upper 10. Additionally, an inelastic shell 30 can help preserve the integrity of the appearance of article of footwear 1, even if shoelace 40 in engaged with hooks 304 in an irregular pattern. In some embodiments, shell 30 is elastic, but less elastic than upper 10, in order to anchor shoelace 40.

FIG. 4 is an exploded view of article of footwear 10. Eyelets 102 are coupled to upper 10, and shoelace 40 extends through eyelets 102 on opposite sides to form lace pathway 402. In some embodiments, shoelace 40 is a single and continuous member, with two fixed ends 404 fixed at a first end of lace pathway 402, and a loop 406 formed at the opposite end of lace pathway 402, such that shoelace 40 does not have a free end. In some embodiments, fixed ends 404 are fixed at the seam line between upper 10 and sole 20. In some embodiments, fixed ends 404 are fixed to the surface of upper 10. In some embodiments, fixed ends 404 are fixed by stitching or gluing. In some embodiments, shoelace 40 is a single closed loop (e.g., continuous or fastened together at or near its ends). In some embodiments, shoelace 40 has two continuous members, each member has a first fixed end 404 fixed at one end of lace pathway 402 and a second fixed end 404 fixed at the opposite end of lace pathway 402.

In some embodiments, lace pathway 402 is defined diagonally across the surface (e.g., extending longitudinally and transversely) of upper 10. For example, as shown in FIG. 4, lace pathway 402 has one end defined close to or at lateral side 114 of toe box 104, and it extends diagonally across upper 10 and towards collar area 106, with the opposite end defined close to or at medial side 116. In some embodiments, lace pathway 402 is defined centrally along a longitudinal direction, with one end defined at toe box 104 and the opposite end defined at collar.

In some embodiments, upper 10 has a tongue-like portion 116 underneath lace pathway 402. Tongue-like portion 116 can be made of a material more flexible than upper 110, such that when shoelace 40 is pulled to provide tension force, tongue-like portion 116 more easily collapses to allow upper 10 to constrict in that area when tightened. In some embodiments, tongue-like portion 116 can be an integral part of upper 10. In some embodiments, tongue-like portion 116 can be a separate part from upper 10.

In some embodiments, shell 30 is fixedly attached (e.g. stitched or glued) to upper 10 at a rim 105 of toe box area 104. In some embodiments, shell 30 is fixedly attached (e.g. stitched or glued) to sole 20 at rim 105 of toe box area 104. And in some embodiments, shell 30 is fixedly attached (e.g. stitched or glued) to the seam line between upper 10 and sole 20. For example, in one embodiment, shell 30 is glued to rim 105, and in another embodiment, shell 30 is stitched to rim 105.

In some embodiments, shell 30 is elastically attached to upper 10 around a collar area 106, such that shell 30 can be stretched away from upper 10 around collar area 106 to help allow a user to don and doff article of footwear 1. In some embodiments, shell 30 can be stretched away from upper 10 around collar area 106 to provide access to shoelace 40 from underneath shell 30, which allows a user to pull a bight portion 408 back from opening 302. In some embodiments, shell 30 has an elastic band 308 connected to collar area 106 of upper 10 that can be stretched out. In some embodiments, upper 10 has a pocket 108 around collar area 106 to receive elastic band 308, such that elastic band 308 is hidden inside pocket 108 when not stretched. In some embodiments, pocket 108 has an opening 109 trimmed with plastic, and opening 109 is visible on upper 10. As used herein, collar area 106 refers to the area adjacent to the top edge of the opening of article of footwear 1, where a foot is inserted.

In some embodiments, shell 30 is fixedly attached to the rest of article of footwear 1 (e.g., upper 10 or sole 20) only at rim 105 of toe box area 104. In some embodiments, when unlaced, shell 30 is coupled to the rest of article of footwear 1 only at rim 105 of toe box area 104 and adjacent collar area 106 (e.g., fixedly attached to rim 105 and elastically attached to upper 10 adjacent collar area 106) and is not coupled to the rest of article of footwear 1 (e.g., upper 10) elsewhere.

Lace 40 and shell 30 together create a customizable lacing system. A user can adjust the tightening force and the appearance of the lacing system by pulling shoelace 40 from different openings 302 and engaging shoelace 40 with different hooks 304. After the user's foot slips into article of footwear 10, the user can feel the tightness of article of footwear 10. If article of footwear 10 fits user's foot with enough tightness, the user can choose not to pull shoelace 40 for additional tightening force, and shoelace 40 is hidden underneath shell 30, for example as shown in FIG. 2. If the user feels that additional tightening force is desired to fit article of footwear 10 to the foot, the user can reach into an opening 302 with fingers and pull shoelace 40 from opening 302 to engage shoelace 40 with hooks 304. Multiple portions of shoelace 40 can be pulled from same or different openings 302 and engaged with same or different hooks 304. If more tightening force is desired, the user can engage shoelace 40 with hook 304 furthest away, and/or the user can pull more portions of shoelace 40 from openings 302 to be engaged with hooks 304. Either method provides more tension within shoelace 40.

Figure 6A:
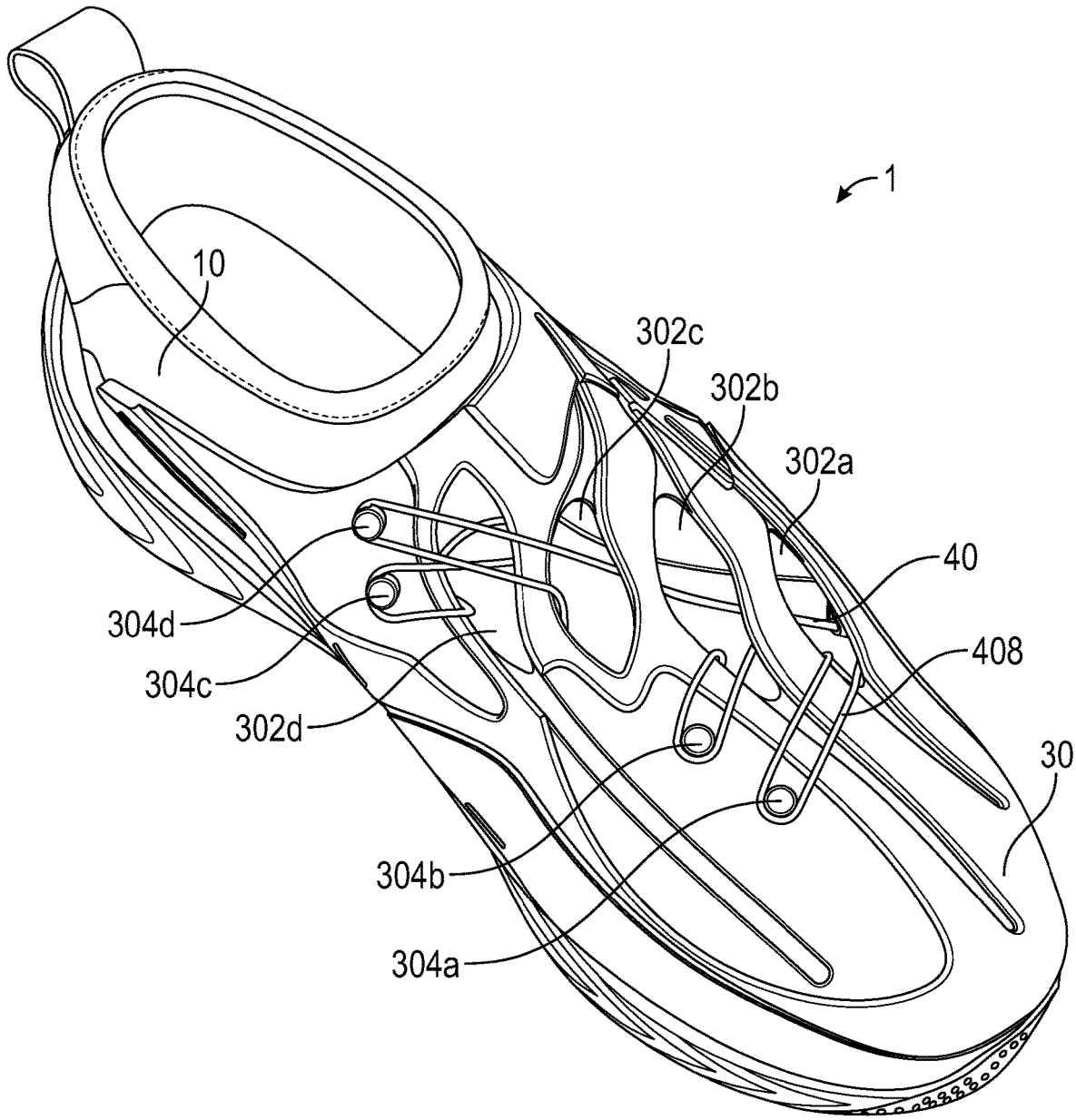
FIGS. 6A-6D are perspective views of the article of footwear of FIG. 1 with different lacing arrangement configurations.

FIG. 6A-6D shows different configurations of shoelace 40 engaging with hooks 304. In some embodiments, as shown in FIG. 6A, shoelace 40 is pulled into four bight portions 408, extending from four different openings 302*a*-302*d* to engage with four different hooks 304*a*-304*d*.

Figure 6B:
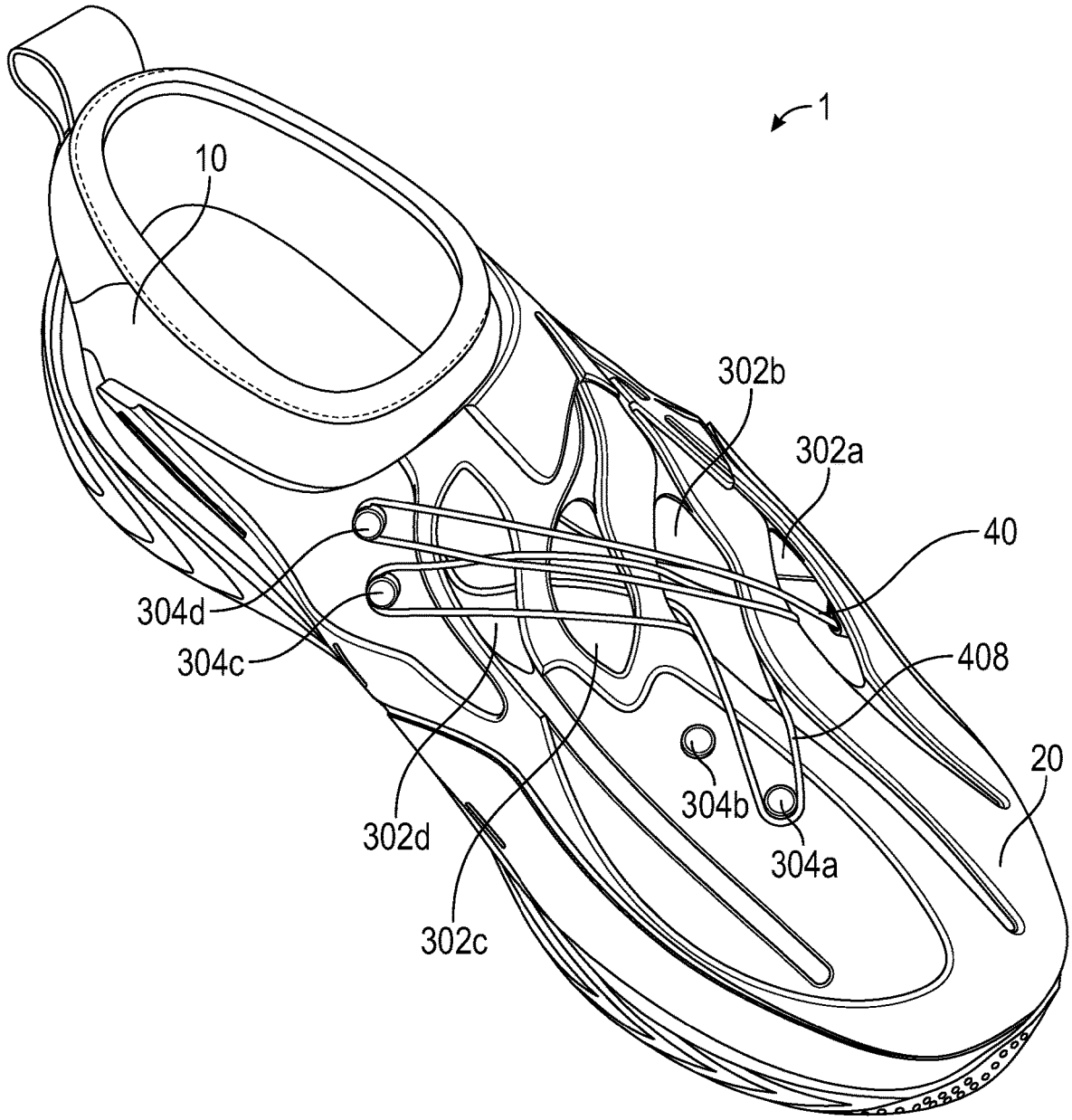

In some embodiments, shoelace 40 can be pulled into fewer bight portions 408, and in some embodiments, multiple bight portions 408 of shoelace 40 can extend from the same opening. For example, as shown in FIG. 6B, shoelace 40 is pulled into three portions, and two bight portions 408 extend from opening 302*b* to engage with different hooks 304*a* and 304*c*.

In some embodiments, a bight portion 408 of shoelace 40 can be stretched to engage with a further away hook to provide more tightening force. For example in FIG. 6B, when bight portion 408 pulled from opening 302 is engaged with the furthest away hook 304*d*, it provides more tightening force than when it is engaged with hook 304*a* in FIG. 6A.

Figure 6C:
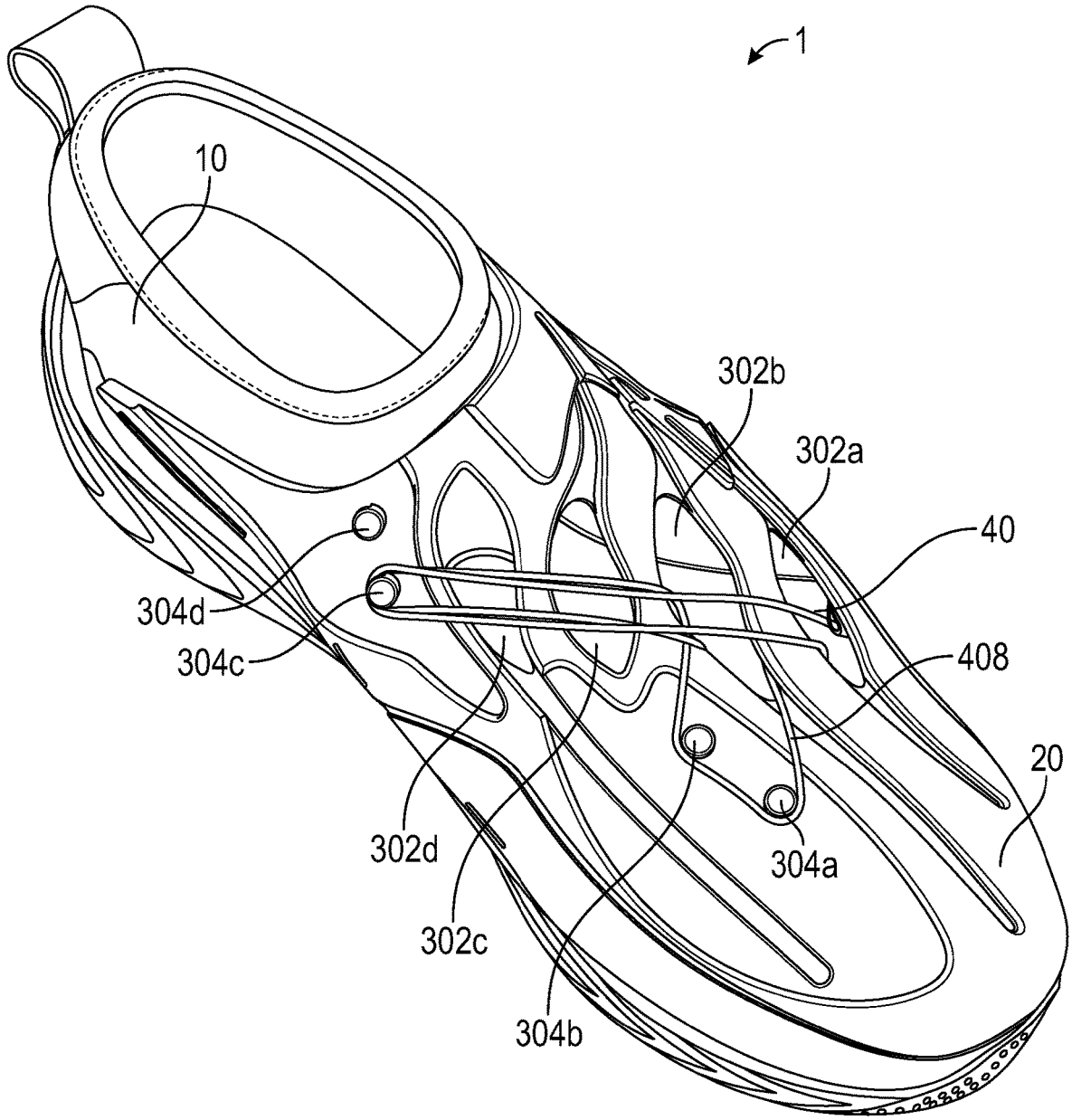

In some embodiments, a bight portion 408 of shoelace 40 can engage with multiple hooks 304, and in some embodiments, multiple bight portions 408 of shoelace 40 can engage with a single hook 304. For example, as shown in FIG. 6C, bight portion 408 pulled from opening 302*b* is engaged with two hooks 304*a* and 304*b*, and bight portions 408 pulled from openings 302*a* and 302*b* are both engaged with hook 304*c*.

Figure 6D:
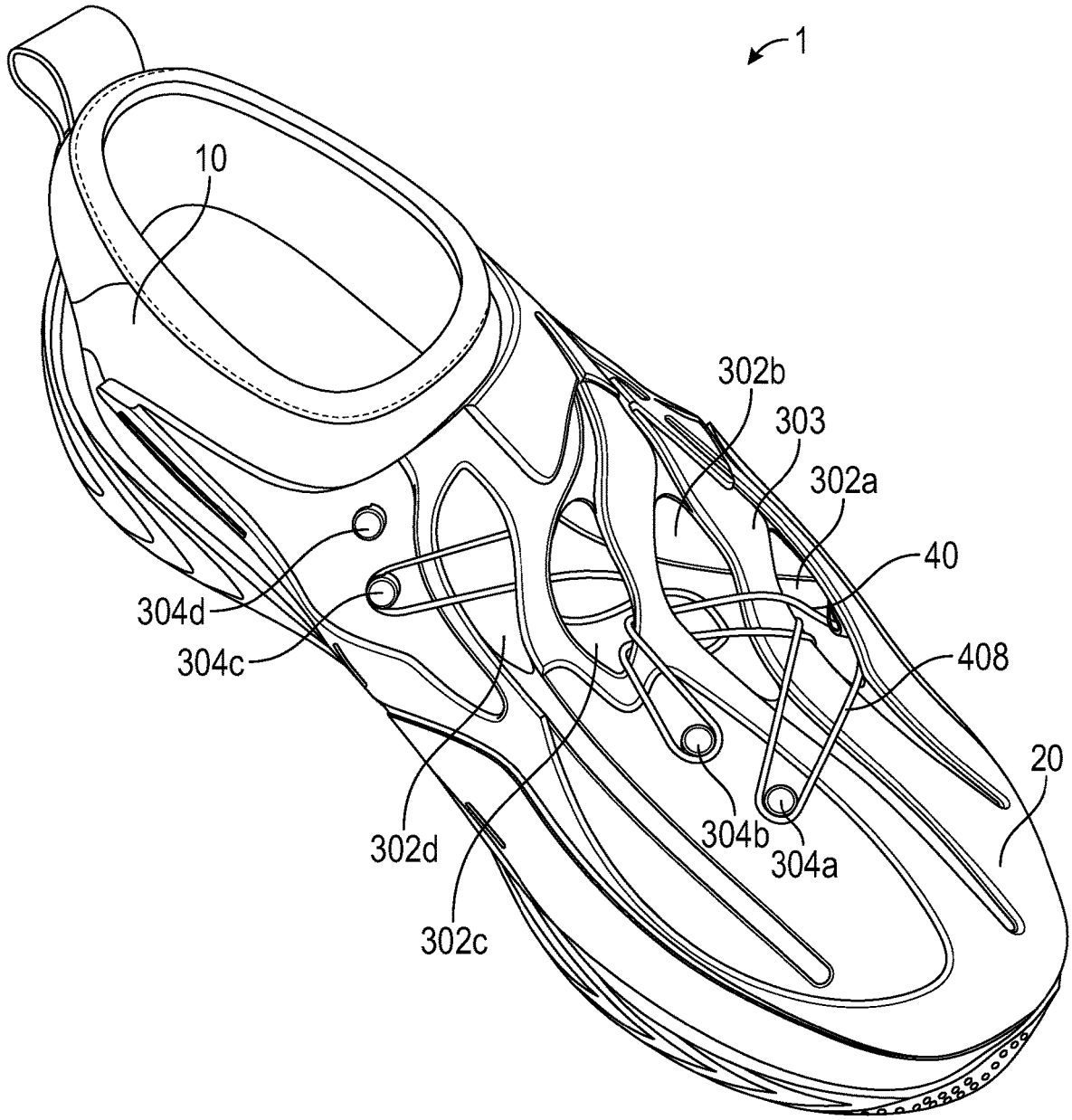

In some embodiments, a bight portion 408 of shoelace 40 can also latch with bridge 303 to provide options of tightening force and appearance. For example as shown in FIG. 6D, bight portion 408 pulled from opening 302*a* is stretched over bridge 303 between openings 302*a* and 302*b* and then stretched underneath bridge 303 between openings 302*b* and 302*c*, before it is engaged with hook 304*b*.

With the customizable lacing system, a user can freely pull any number of bight portions 408 of shoelace 40 from openings 302 to engage with any one of hook 304 and/or bridge 303 to satisfy the desired tightening force and aesthetic appearance. As the number of openings 302 and hooks 304 increases or decreases, the customizable options also increases or decreases. It is understood that no one example of configuration discussed above limits the scope of the disclosure, and any configuration not discussed above is also within the scope of the disclosure.

It is to be appreciated that the Detailed Description section, and not the Summary and Abstract sections, is intended to be used to interpret the claims. The Summary and Abstract sections may set forth one or more but not all exemplary embodiments of the present disclosure as contemplated by the inventor(s), and thus, are not intended to limit the present disclosure and the appended claims in any way.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the claims and their equivalents.

The claims in the instant application are different than those of the parent application or other related applications. The Applicant therefore rescinds any disclaimer of claim scope made in the parent application or any predecessor application in relation to the instant application. The Examiner is therefore advised that any such previous disclaimer and the cited references that it was made to avoid, may need to be revisited. Further, the Examiner is also reminded that any disclaimer made in the instant application should not be read into or against the parent application.

What is claimed is:

1. An article of footwear, comprising:

an upper comprising eyelets that define a lace pathway therebetween;

a shoelace extending through the eyelets;

a shell overlying the upper, the shell defining openings over the lace pathway; and hooks coupled to the shell, wherein the shoelace is configured be extended out through the openings to releasably engage with the hooks to tighten the upper.

2. The article of footwear of claim 1, wherein the shoelace is elastic.

3. The article of footwear of claim 1, wherein the shell is not fixed to the upper in an instep region of the upper, such that the upper is free to move relative to the shell in the instep region.

4. The article of footwear of claim 1, wherein the shoelace forms a single loop.

5. The article of footwear of claim 1, wherein the shoelace is a single, continuous member having a first end and a second end, and wherein both the first and second end are fixed to the upper.

6. The article of footwear of claim 5, wherein the first end and the second end of the shoelace are fixed at the same end of the lace pathway.

7. The article of footwear of claim 1, wherein the openings are arranged in a row over the lace pathway and extend longitudinally and transversely over the upper.

8. The article of footwear of claim 1, wherein each of the openings has a minimum diameter in a range of 10 mm to 30 mm.

9. The article of footwear of claim 1, wherein the openings are arranged in a single row over the lace pathway.

10. The article of footwear of claim 1, wherein the upper is elastic, and wherein the shell is inelastic.

11. The article of footwear of claim 1, wherein the upper and the shell are flexible, and wherein the upper is more flexible than the shell.

12. The article of footwear of claim 1, wherein the upper is formed of a textile material, and wherein the shell is formed of a solid material.

13. The article of footwear of claim 1, wherein the shell is fixed to a toe box of the article of footwear.

14. The article of footwear of claim 1, wherein the shell elastically coupled to the upper at a collar area of the upper.

15. The article of footwear of claim 1, wherein the hooks comprises at least four hooks.

16. The article of footwear of claim 1, wherein the hooks are monolithic with the shell.

17. The article of footwear of claim 1, wherein each of the hooks is arranged at a different distance from any one of the openings.

18. The article of footwear of claim 1, wherein the shell extends over an instep region of the upper.

19. The article of footwear of claim 1, wherein the lace pathway extends diagonally across the upper.

20. The article of footwear of claim 1, wherein a bridge is formed between two adjacent openings, and the shoelace is configured to extend over the bridge.

21. The article of footwear of claim 1, wherein at least a portion of the shoelace is underneath the shell.

22. An article of footwear, comprising:

an upper;

an elastic shoelace coupled to the upper; and a shell disposed over the upper, the shell comprising:

a single row of openings disposed over the shoelace; and hooks disposed adjacent the openings, wherein bight portions of the shoelace are configured to be pulled through the openings and over the hooks to provide tightening force.

23. The article of footwear of claim 22, wherein hooking bight portions of the shoelace pulled through the same opening over different hooks provides different tightening forces.

24. The article of footwear of claim 22, wherein the shoelace is configured to be hooked over more than one hook simultaneously.

25. The article of footwear of claim 22, wherein the tightening force tightens the shell to the upper.

26. A method of tightening an article of footwear, the method comprising:

pulling a shoelace through a first opening defined on a shell to form a first bight in the shoelace;

hooking the first bight of the shoelace over a first hook fixed to the shell;

pulling the shoelace through a second opening defined on the shell to form a second bight in the shoelace; and hooking the second bight of the shoelace over a second hook fixed to the shell, wherein the shell overlays an upper, wherein the shoelace is coupled to the upper, and wherein hooking the bights over the hooks constricts the upper relative to the shell.

27. The method of claim 26, wherein pulling the shoelace through the openings comprises extending a finger through the opening and pulling the shoelace through the opening with the finger.

28. The method of claim 26, further comprising adjusting the tightness of the article of footwear by moving one of the bights to a different hook.

* * * * *